US005251724A

United States Patent [19]

Szatkowski et al.

[11] Patent Number: 5,251,724

[45] Date of Patent: Oct. 12, 1993

[54] RAIL LUBRICATION APPLICATION SYSTEM

[75] Inventors: James G. Szatkowski, Elmhurst; Timothy D. Kohler, Frankfort, both of Ill.

[73] Assignee: General Motors Corporation, Detroit, Mich.

[21] Appl. No.: 851,726

[22] Filed: Mar. 16, 1992

[51] Int. Cl.[5] ..... B61K 3/00

[52] U.S. Cl. ..... 184/3.2; 184/99

[58] Field of Search ..... 184/3.1, 3.2, 2, 99, 184/45.2; 104/279; 198/500

[56] References Cited

U.S. PATENT DOCUMENTS

| | | | |
|---|---|---|---|
| 990,637 | 4/1911 | Dawson | 184/3.2 |
| 1,088,928 | 3/1914 | Reid | 184/3.2 |
| 1,177,632 | 4/1916 | Johnson | 184/3.2 |
| 1,222,341 | 4/1917 | Wholey | 184/3.2 |
| 1,756,726 | 4/1930 | Brost | 184/3.2 |
| 1,912,490 | 6/1933 | Miller, Jr. | 184/3.2 |
| 2,160,784 | 5/1939 | Milbank | 184/3.2 |
| 2,580,687 | 1/1952 | McMillan | 184/3.2 |
| 2,637,411 | 5/1953 | Harbison | 184/3.2 |
| 2,866,521 | 12/1958 | Gibson | 184/3.2 |
| 2,935,159 | 5/1960 | Burrell | 184/3.2 |
| 4,811,818 | 3/1989 | Jamison | 184/3.2 |
| 5,054,582 | 10/1991 | Aracil | 184/3.2 |
| 5,085,292 | 2/1992 | Dial | 184/3.2 |

FOREIGN PATENT DOCUMENTS

| | | | |
|---|---|---|---|
| 0110896 | 11/1917 | United Kingdom | 184/3.2 |

OTHER PUBLICATIONS

Electro-Motive's Wheel Flange Lubrication System Brochure, LB17-890, 1990 General Motors Corporation.

Electro-Motive's Wheel Flange Lubricator Parts List A1524, Nov., 1961.

*Primary Examiner*—Richard R. Cole
*Assistant Examiner*—Alan B. Cariaso
*Attorney, Agent, or Firm*—Robert J. Outland

[57] ABSTRACT

A lubrication applicator presses a block of solid lubricant against the flange of a locomotive wheel. An applicator nozzle loosely fits over the body of the applicator and lightly engages the block of lubricant to bridge the gap between the body and the wheel. The applicator is supported by a main bracket fixed to an unsprung portion of the locomotive truck, such as a journal box or a traction motor, and an adjustable bracket which establishes a good attitude of the applicator and is movable radially of the wheel to accommodate wheels of different diameters. A bracket attached to a journal box fits in a restricted space between the truck frame and the wheel and comprises a plate with upper and lower channels attached to opposite sides to provide strong and light structures subject to minimal inertial loading in a severe vibrational environment. To lessen the inertial forces the brackets angle upward (rather than horizontally) to position the applicator within about 45° of the vertical plane of the wheel.

19 Claims, 6 Drawing Sheets

FIG - 3
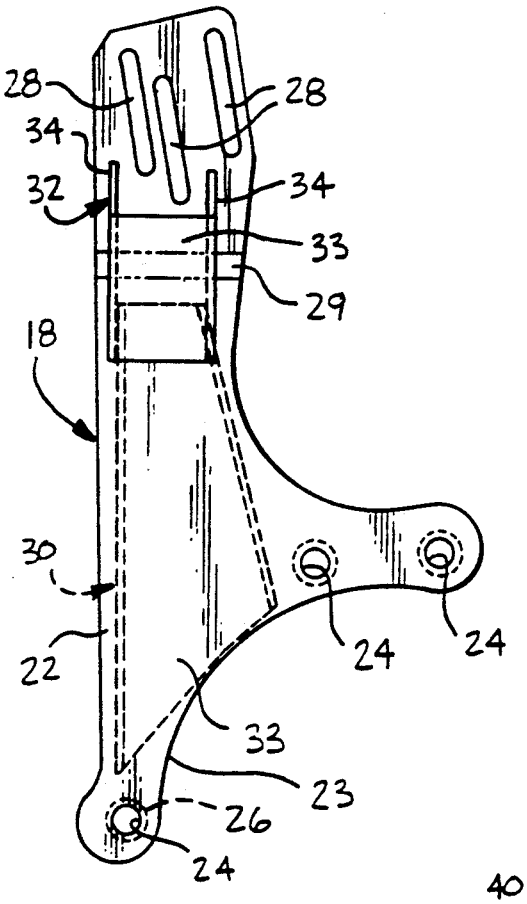
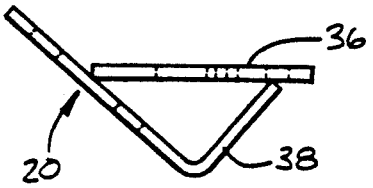
FIG - 5
FIG - 6
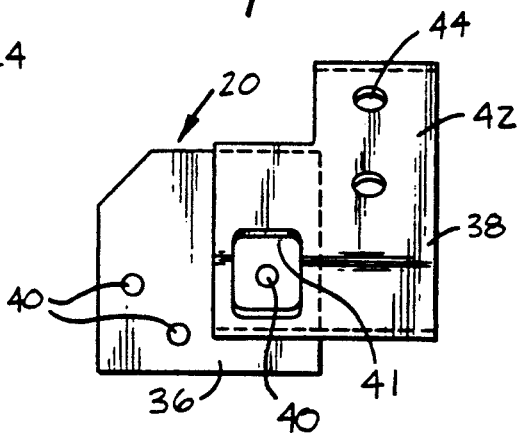
FIG - 7
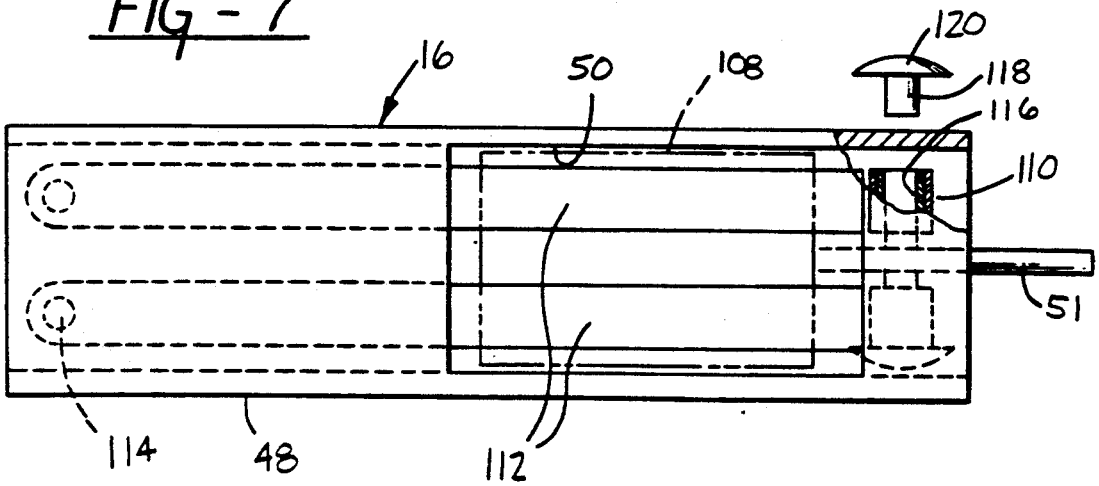

50
51
16
46
48
42
52
38
14
53
36
17
20
15
12
29
32
33
12'
34
34
18
33
30
22
26
10

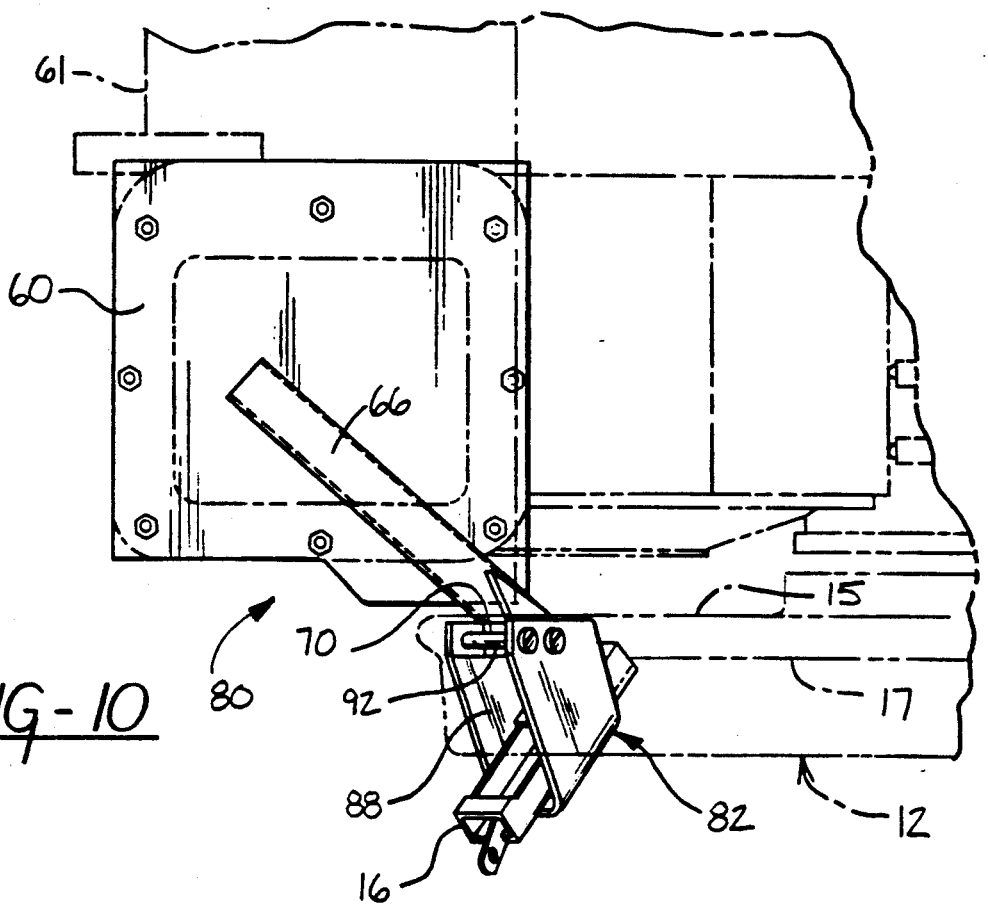
FIG-10
FIG-11
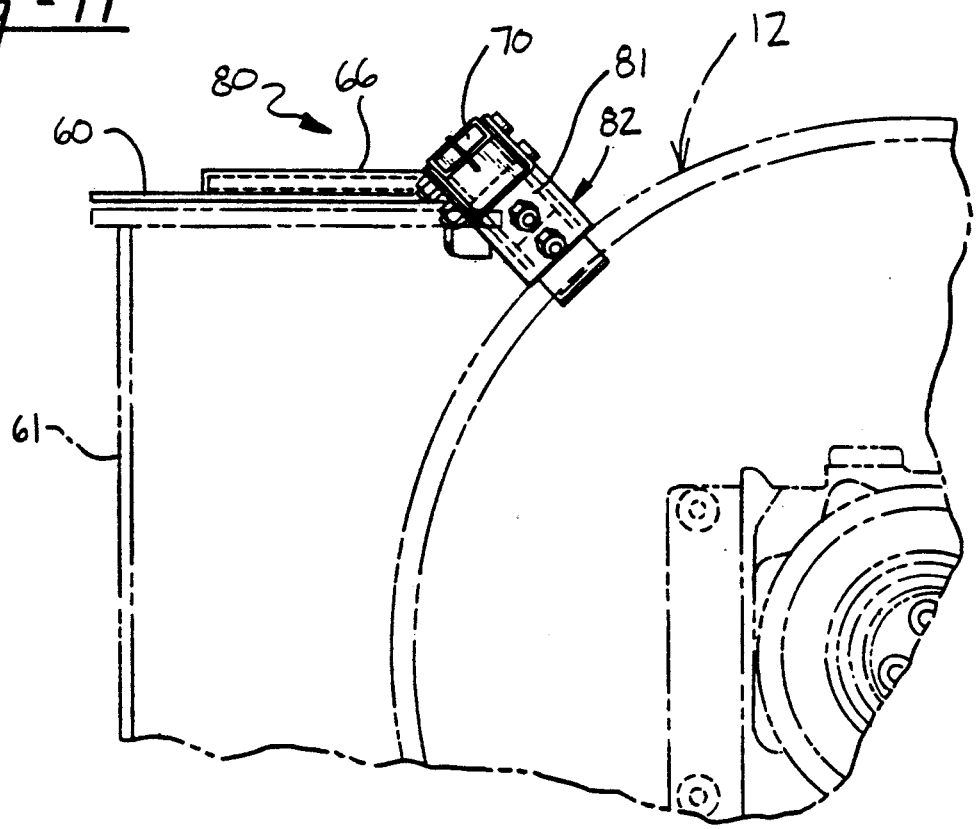

RAIL LUBRICATION APPLICATION SYSTEM

TECHNICAL FIELD

This invention relates to the application of lubricant to railroad rails and particularly to a rail lubrication system mounted on a locomotive truck.

BACKGROUND

It is known in the art relating to rail lubrication to apply a lubricant to locomotive wheels to minimize friction between the wheel flanges and rails, especially on curves. In the early 1980's studies performed by the Association of American Railroads revealed substantial fuel consumption reductions during testing with flange lubrication. The railroad industry quickly adopted equipment mounted on board locomotives. The continuous application of lubricant to the flanges of locomotive wheels and thus the rails is today an industry practice.

Previous systems which have been developed primarily utilize a liquid lubricant such as oil or grease which is sprayed on the wheels. Practical experience has shown that these systems are unreliable and often difficult to retrofit. Much difficulty has been experienced in the application to the trucks of the locomotive due to the clearance considerations and adverse environment which includes high vibrations and severe dirt contamination. Typical grease or oil based systems mount their applicator nozzles on the truck frame of the locomotive which is spring mounted relative to the wheels. Although the vibration environment is improved, the alignment of the nozzles to the wheels is not accurate due to the relative motions of the wheels to the truck frame.

Development of solid lubrication materials to replace the liquids offers potential improvements in delivery accuracy and delivery effectiveness due to reduced fling-off. Solid lubrication materials have been used or tried in the past. Such systems typically were mounted on the truck frame and gravity or spring pressure was used to urge a block of lubricant toward a wheel flange. Alternatively, a guide shoe was used to align the system to the wheel, and a stick of lubricant in a tubular holder was fed against the wheel flange. Mounting on the truck frame inevitably requires some sort of mechanism to compensate for the wheel relative motions. Tracking or complicated guidance mechanisms have typically yielded very poor results.

The application of solid lubrication materials to the wheels presents significant difficulties in positioning, alignment, and durability of the system. In particular, mounting brackets and equipment mounted on the unsprung truck components (wheels and motors) must be durable in the severe environment. It has been proposed to avoid mounting on the truck frame by mounting on an unsprung portion such as the journal box. Particularly, it has been proposed to use a heavy bracket (½ inch steel plate) extending horizontally outward from the journal box to the wheel flange area. These types of brackets were found to be too bulky and severe problems with strength of the attachment to the journal box were experienced. Due to large inertial loads developed in the high vibration environment, simple, heavy brackets are not optimal and problems of fatigue and fastener deterioration can be expected.

Applicators for dispensing solid lubricant to the wheel flanges have also been proposed. Even when optimum bracket design is employed there can be some small movement of the wheel relative to the dispenser and, depending on the journal box design, there may be substantial movement. The applicator should be able to compensate for such movement and at the same time should be as close as possible to the wheel flange to avoid a gap which is bridged only by unsupported lubricant.

SUMMARY OF THE INVENTION

The present invention overcomes the aforementioned problems by providing a lubricant system mounted on the unsprung portion of the locomotive truck by a relatively light weight bracket which is both stiff and fatigue resistant and is arranged to minimize the inertial loads developed in the high vibration environment. The invention is also carried out by providing an improved applicator.

The invention is carried out, in a locomotive having wheels supporting a truck wherein the truck has an unsprung portion associated with the wheels, by a rail lubrication system comprising: a tubular applicator having an end for dispensing lubricant; solid lubricant held within the applicator for application to a locomotive wheel flange; means for holding the applicator adjacent a wheel flange for lubricant application to the flange including a first bracket secured to the unsprung portion of the truck near a wheel and extending toward the wheel periphery and a second bracket adjustably secured to the first bracket and attached to the tubular applicator to adjustably position the said end of the applicator adjacent the flange.

The invention is also carried out by such a holding means wherein the first bracket is a lightweight rigid structure mounted on a journal box and extends upward at an angle to the wheel periphery. The invention is further carried out by such a holding means having a first bracket attached to the locomotive traction motor near a wheel.

The invention is further carried out by an applicator having an improved spring assembly and by a nozzle for bridging the gap to the wheel.

These and other features and advantages of the invention will be more fully understood from the following descriptions of certain specific embodiments of the invention taken with the accompanying drawings.

BRIEF DRAWING DESCRIPTION

In the drawings:

FIG. 3 is a side view of a main bracket of the lubricant system of FIG. 1 according to the invention;

FIGS. 5 and 6 are front edge and inner side views, respectively, of an adjustable bracket of the lubricant system of FIG. 1, according to the invention;

FIG. 7 is a partly broken away and partly exploded view of a lubricant applicator for the system of FIG. 1, according to the invention;

Figure 4:
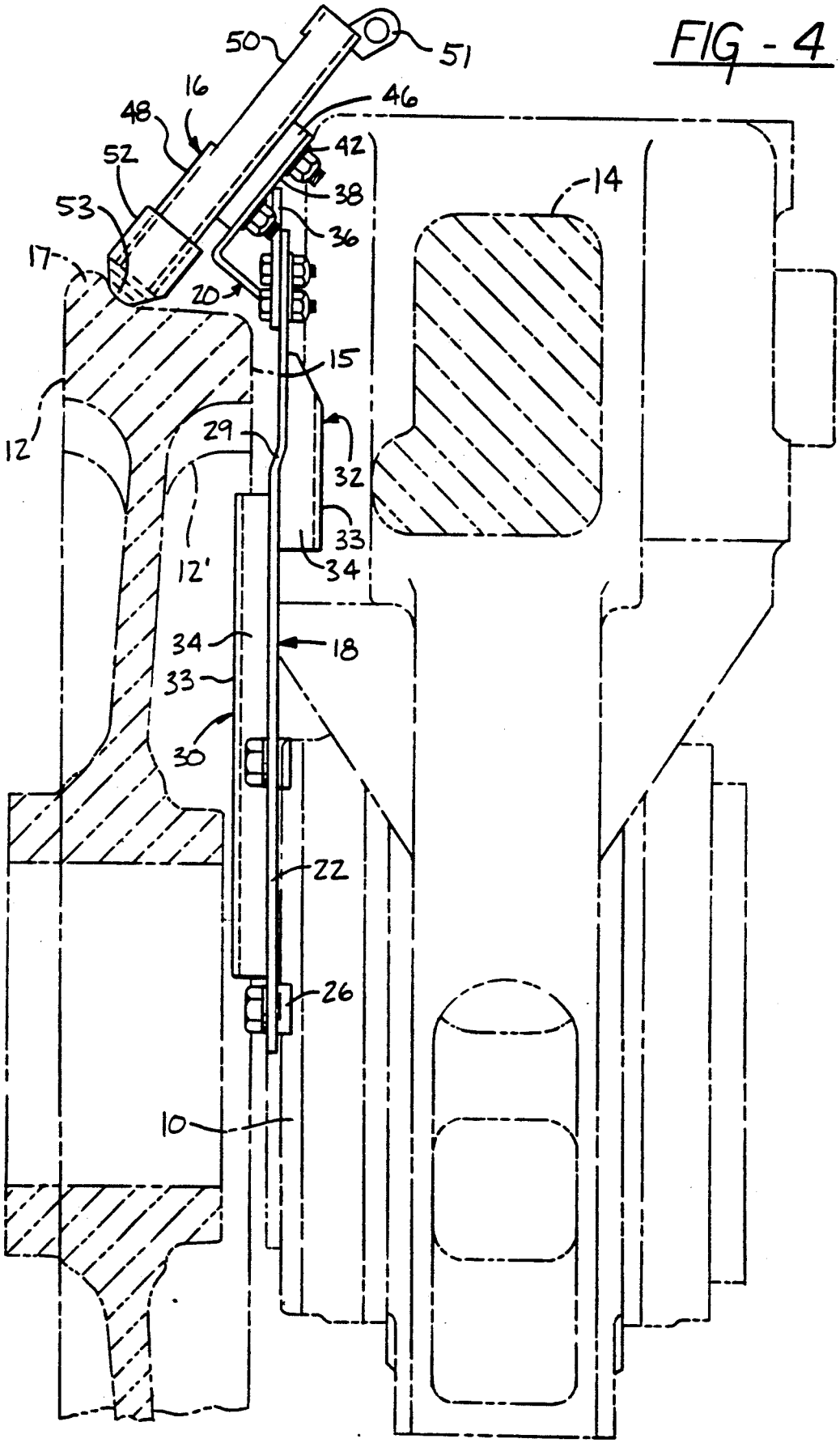
FIG. 4 is a cross section taken along line 4—4 of FIG. 1 showing a front edge view of the lubricant system according to the invention.
Figure 8A:
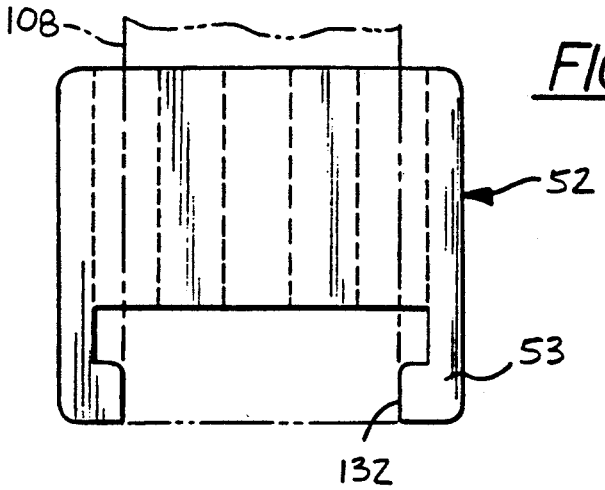
Figure 8B:
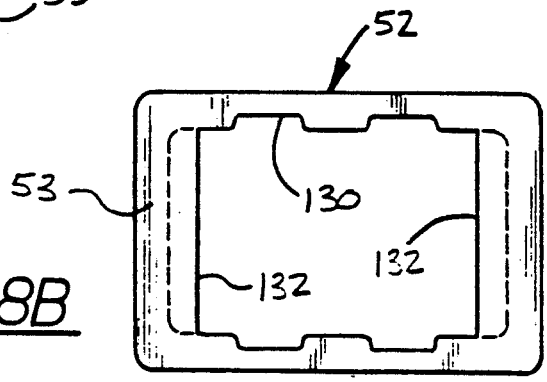
Figure 9:
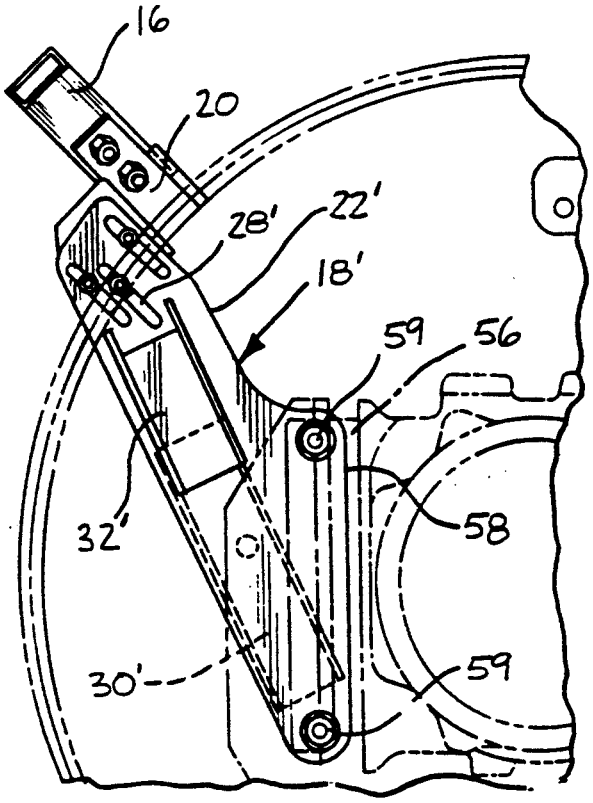
Figure 12:
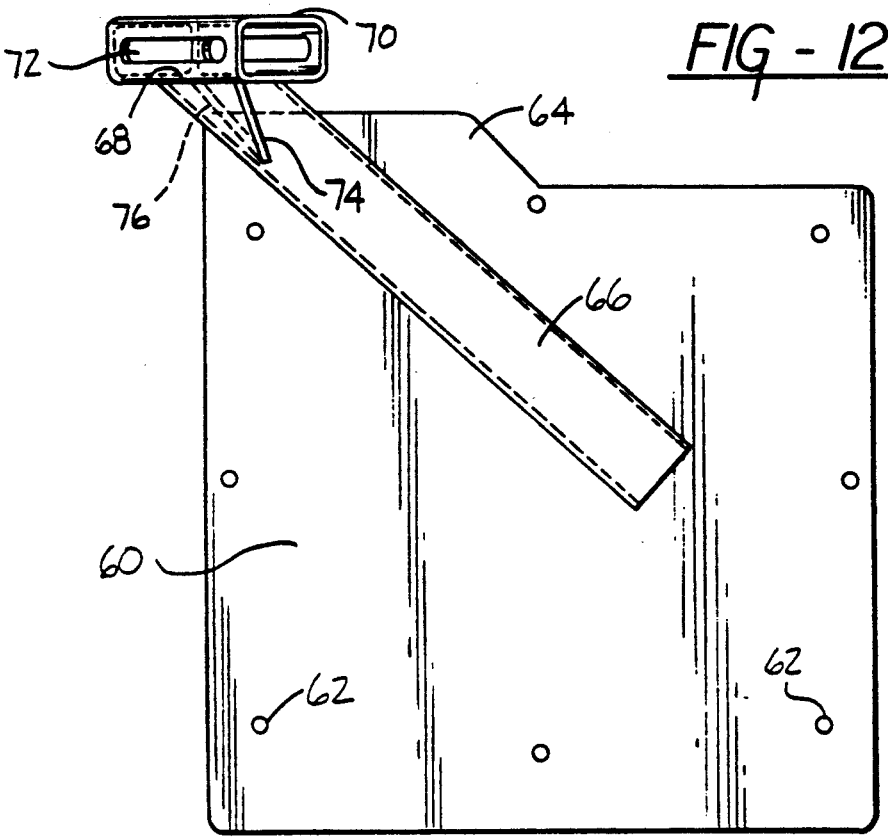
Figure 13:
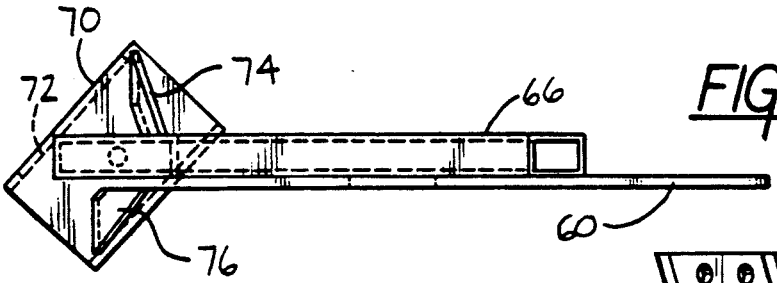
Figure 14:
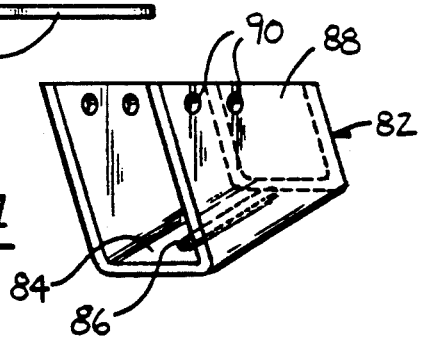
Figure 15:
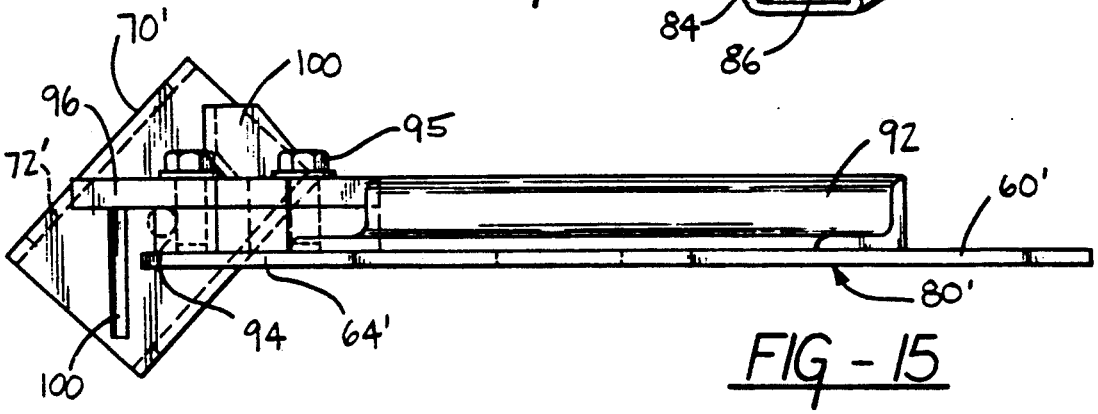

FIGS. 8*a* and 8*b* are top and end views of a nozzle for the applicator of FIG. 4, according to the invention;

FIG. 9 is a side view of a lubricant system mounted on a locomotive using another embodiment of the main bracket according to the invention;

FIGS. 10 and 11 are top and side views, respectively, of another embodiment of a lubricant system mounted on the traction motor of a locomotive;

FIGS. 12 and 13 are top and inner side views, respectively, of a main bracket for the system of FIGS. 10 and 11, according to the invention;

FIG. 14 is an isometric view of an adjustable bracket for the system of FIGS. 10 and 11, according to the invention; and FIG. 15 is an inner side view of another embodiment of the main bracket for the system of FIGS. 10 and 11.

DETAILED DESCRIPTION

The ensuing description is directed to mounting structure for lubricant systems developed specifically for application to locomotives built by Electro-motive Division (EMD) of General Motors Corporation, but with minor dimensional changes such structures are applicable as well to other locomotive designs. The locomotive designs sometimes differ in the style of outer axle support which is variously known as a journal bearing or a journal box. Such a device is generally referred to herein as a journal box and is used as an unsprung mount for a support bracket. A known solid lubricant disclosed in U.S. Pat. No. 4,915,856 is the substance to be applied to the wheel flange. The lubricant is in the form of a block and is dispensed by an applicator comprising a tubular housing and a constant force spring roller assembly which pushes against the lubricant block. Application of the lubricant to the wheel is constant while rate of deposition is controlled by the lubricant formulation and the force of application.

Figure 1:
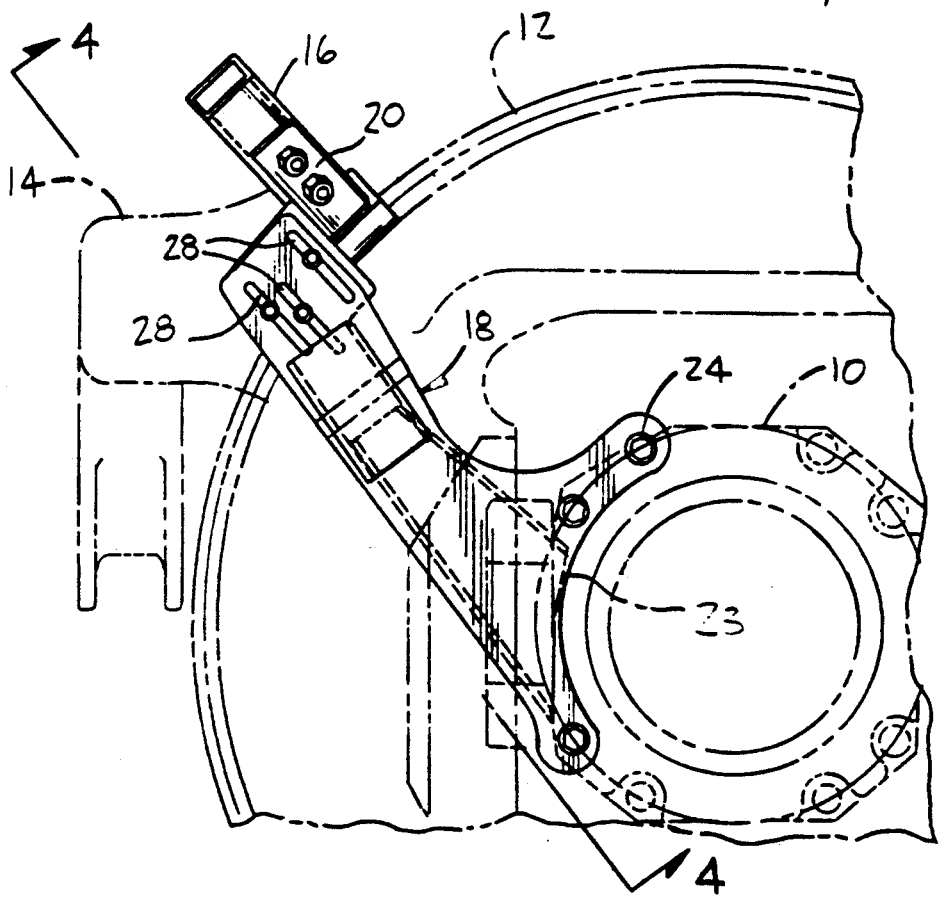
FIGS. 1 and 2 are side and top views of a rail lubricant system mounted on a locomotive journal box according to the invention.
Figure 2:
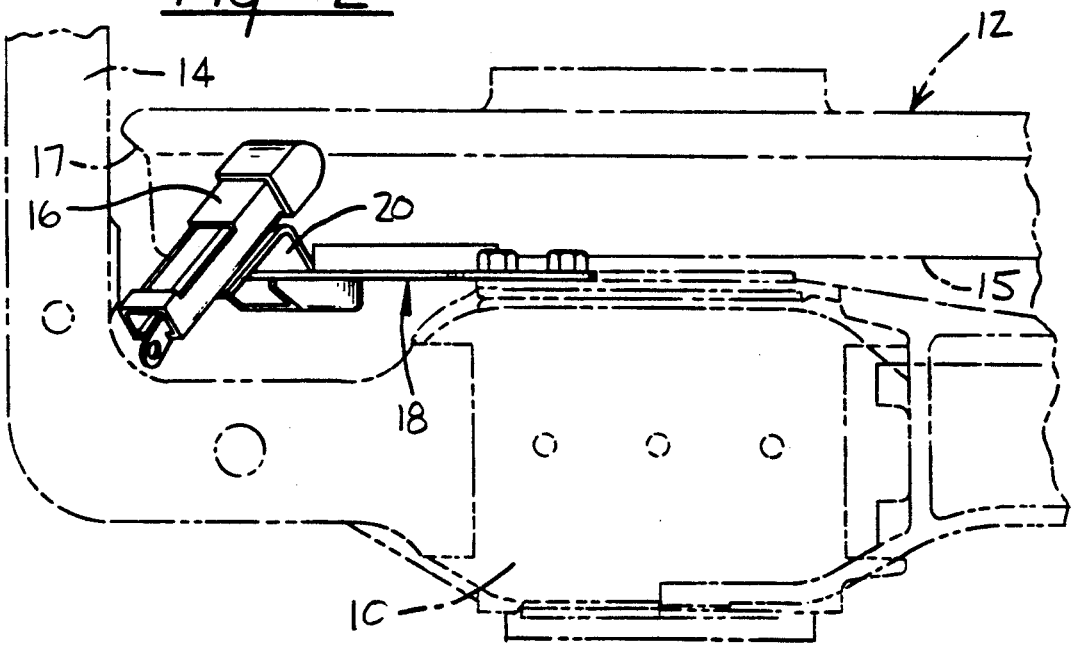

Referring to FIGS. 1 and 2, which show a portion of a locomotive truck, a journal box 10 is supported by a wheel 12 through an axle rotatable with the wheel on an axis, not shown, such that the wheel and the journal box are always in the same relative position. The journal box 10 supports a truck frame 14 via springs, not shown, so that the frame 14 is movable relative to the wheel 12 and journal box 10. A lubricant applicator 16 is supported beyond the wheel rim 15 at a position of about 45° from the vertical plane through the axis of the wheel 12, and is held with one end against the side of the wheel flange 17. The applicator 16 is supported by a main, fixed bracket 18 bolted to the journal box 10 and an adjustable bracket 20 secured to the outer end of the main bracket 18.

The main bracket 18, also shown in FIGS. 3 and 4, is constructed of a reinforced ¼ inch plate 22 and has a curved lower boundary 23 furnished with three holes 24 for bolting to the journal box at existing bolt positions and an annular boss or spacer 26 at each hole 24 to provide a necessary offset to fit the bracket to the counterbored or relieved surfaces of the journal bearing assemblies. At the upper end of the bracket 18, three parallel slots 28 serve as mounting holes for the adjustable bracket 20. The slots 28 are parallel to the wheel radius which extends through the applicator 16. Thus the adjustment allows movement of the applicator directly toward or away from the wheel axis and accommodates different diameter wheels. The bracket 18 has an offset 29 at a location between the slots 28 and the holes 24 to provide clearance.

The reinforcement of the main bracket 18 comprises a large channel 30 and a small channel 32 on opposite sides of the bracket. Each channel comprises a central web portion 33 bounded by a flange 34. The flanges are welded to the plate 22 to create box sections for stiffness. The large channel 30 is uniquely shaped to fit between the plate 22 and the wheel 12 while maximizing the structural elements. The channel 30 is tapered from a wide lower end near the bolt holes to a narrow upper end near the offset 29. The tapering shape improves fatigue resistance in critical sections adjacent the attachment holes. The small channel 32 is attached to the side of the plate 22 opposite the wheel 12 and maintains a uniform rectangular cross section throughout its length. The small channel overlaps the upper end of the large channel 30 and the offset 29 and extends up to the slots 28. At the top of the small channel 32 the flanges taper off to provide a transition in the structure which reduces stresses and increases fatigue resistance. The offset 29 and the staggered relationship of the channels 30 and 32 enables the bracket to fit in the restricted space adjacent the bearing journal 10, the wheel 12, and the frame 14 and provides adequate clearance to accommodate relative motions between these elements.

The restricted space is illustrated in FIG. 4 wherein the wheel 12 and the frame 14 are cross hatched and the journal box 10 is in phantom lines. It can be seen that by mounting the channel 30 on the wheel side of the plate 22 the lower end of the channel does not interfere with the journal box 10, and the upper end can extend to a point near the under side of the wheel rim. Due to the bracket width the distance between its top and the rim varies; the line 12' illustrates the proximity of the rim to the nearest corner of the channel 30. Thus the channel 30 partially intrudes into the envelope of the wheel rim. The channel 32 then is placed on the opposite side of the plate 22 to avoid interference with the rim and is spaced from the frame 14. The small offset 29 also helps avoid interference of the plate with the rim. Both the wheel 12 and the frame 14 can move laterally a fraction of an inch and the bracket 18 is sufficiently spaced from both members to maintain a clearance.

The adjustable bracket 20, shown in FIGS. 5 and 6 comprises a flat plate 36 welded to an angle plate 38. The flat plate 36 has three bolt holes 40 for bolting the plate 36 to the slotted main plate 22. The angle plate 38 has one half overlapping the flat plate 36 and has both legs of the angle welded thereto to provide a rigid structure; a bolt access opening 41 is formed in the apex of the angle. The other half extends beyond the flat plate 36 and provides an angled mounting surface 42 for positioning the applicator 16 at a suitable angle to the wheel and bolt holes 44 for attaching the applicator. The mounting surface 42 extends beyond the flat plate 36 to provide a sufficiently large support for the applicator.

The brackets described herein are preferably steel and are assembled by welding. Such devices have performed well in testing. To make the assembly lighter, other materials such as aluminum could be used, although steel is less expensive. Also rather than welding parts together, the same shapes could be made by casting. Similar brackets might also be made by forming or stamping.

The bracket design described herein is unique in that previous brackets have typically been heavy plates which extend horizontally from the journal box. Those previous designs performed poorly due to the high inertia loadings which resulted from the high acceleration levels at the journal box and their large mass. The design according to the invention is light in weight to reduce the inertia loading and optimized for maximum stiffness and strength. The placement at the high position spaced 45° or less from the vertical plane of the wheel axis is also unique and tends to reduce the inertia loadings in the brackets. The clearance problems in this area are much greater thus leading to the specific placement of the stiffening channels. The low weight of the brackets also facilitates handling and application to the locomotive. The particular design described above attaches to the journal box of a Hyatt bearing which is an industrial standard bearing for locomotives. In some applications other bearings might be used and the brackets would have to be modified to fit.

The applicator 16 as shown in FIGS. 4, 7, 8*a* and 8*b* is attached to the adjustable bracket 20 via a spacer block 46 so that the applicator is aligned with the outer flange surface 17 of the wheel 12. The applicator 16 has a tubular body 48 of rectangular cross section. A cutout 50 on one side of the body permits insertion of a lubricant block 108. A retraction and latching tab 51 for retracting the inner spring assembly extends from the rear of the applicator body 48 and has a hook portion which latches on the edge of the body 48. The forward end of the applicator 16 is covered by an elastomeric nozzle 52. While the concept of a tubular body holding a block of solid lubricant and a constant force spring assembly for advancing the block is known, improvements have been made to the spring assembly and the nozzle 52 has been added.

The spring assembly 110 comprises a pair of coiled flat springs 112 attached by rivets 114 to the front end of the body 48 at one side thereof and coiled around a steel sleeve 116. Plastic end plugs 118 fit within each end of the sleeve 116 and have large diameter heads 120 to contain the springs 112. The plugs 118 have an interference fit in the sleeve so that no separate fasteners are used. The plugs are preferably nylon and slide easily inside the tubular body 48 as the sleeve advances. The retraction and latching tab 51 is mounted on the sleeve 116 between the two springs 112. As shown in the drawings the tab 51 is hooked over the rear end of the body 48 and the springs 112 are mainly in uncoiled condition except for a few turns around the sleeve 116. The block 108 of lubricant is then inserted through the opening 50. When the tab 51 is released, the springs 112 exert a force on the sleeve toward the front of the applicator to push the lubricant block 108 forward.

The nozzle 52 is provided to bridge the gap between the front of the tubular body 48 and the wheel flange. The nozzle slides loosely on the body 48 to accommodate any relative motion between the wheel and the applicator having a component in the direction of the applicator axis. By bridging the gap the nozzle helps retain and utilize the end portion of a nearly consumed block of lubricant, it prevents contact of the tubular body 48 with the wheel, and it helps keep out dirt. The nozzle must have good wear in a dirty environment; although it is considered to be a consumable part, it should have a useful life spanning the usage of many lubricant blocks. A urethane-composition is expected to be satisfactory for the intended purpose.

FIGS. 8*a* and 8*b* show the nozzle 52 shape. It has a generally rounded nose 53 (FIG. 4) conforming to the shape of the wheel flange. The body of the nozzle 52 is rectangular to fit over the body 48 and has interior grooves 130 to clear the rivets 114. The nose 53 has an in-turned flange or finger 132 on each side to provide a light drag on the lubricant block 108 as it is fed from the applicator body 48. Then the lubricant and the nozzle will move together in the case of any relative movement between the wheel and the applicator body, but the lubricant block will advance through the nozzle as the lubricant is consumed.

FIG. 9 shows a modified-main bracket 18' for a locomotive application using a Timken bearing equipped with a bearing adapter 56. The bracket 181 comprising a plate 22' without an offset extends from a bearing attachment location to an upper end with slots 28' which are functionally the same as the slots 28. The bracket 18' has a vertical edge 58 for attaching to the bearing adapter; upper and lower holes 59 along the edge 58 are provided for attachment at existing bolt locations. A large lower channel 30' on one side of the plate extends from a point near the lower attachment hole 59 to a point part way toward the upper end. A short channel 32' on the other side of the plate 22' overlaps the upper end of the channel 30' and extends up to the slots 28'. The channels are of uniform width. They provide stiffening of the bracket and increase the fatigue resistance. As in the bracket 18, the construction is preferably welded but casting or other technology may be used as well. Similarly, the material is preferably steel but alternative materials such as aluminum may be used. The adjustable bracket 20 and the applicator 16 are the same as used in the previously described embodiment.

Switching locomotives can be equipped with a lubricant system using another type of mounting. As is well known, EMD locomotive traction motors are generally between the truck frame and a drivingly connected wheel axle and are provided with an air duct having an opening in the upper side of the motor housing. Road locomotives have a flexible duct attached to the air opening so that there is no convenient place to attach a bracket for the system. Switching locomotives, on the other hand, use other duct arrangements and a cover is placed over the air opening. The opening is near a wheel and since the traction motor, through its pivotal connection with the axle, is part of the unsprung mass of the truck it is advantageously used as a bracket mounting location.

The switcher brackets which mount to the traction motor can be constructed in a fixed and a detachable version. The fixed version is designed to provide the maximum strength and stiffness with the fewest number of bolted joints. The detachable version allows the users employing large, flanged brake shoes the flexibility to remove the upper portion of the bracket to facilitate brake shoe replacement. FIGS. 10 through 13 show a rail lubricant system for a switcher using the fixed version of brackets. A plate 60 is mounted over the cover of the air opening of a traction motor 61 and has peripheral bolt holes 62 in a pattern conforming to the bolts for the cover. The plate provides the foundation for the balance of the components and the corner of the plate 60 adjacent the wheel has an extension 64 overhanging the motor. A long rectangular tube 66 is diagonally positioned on the plate 60 and has one end extending beyond the extension 64 toward the wheel. The tube stiffens the plate 60 and distributes the loads from the applicator 16 which is cantilevered off the assembly. The end 68 of the long tube 66 nearest the wheel is cut at an angle in a plane parallel to the plane of the wheel.

A short rectangular tube 70 is welded to the end 68 of the long tube 66 with the longitudinal axis of the tube 70 parallel to the wheel radius. The narrow sides of the short rectangular tube 70 have longitudinal slots 72 for adjustable attachment of an adjustable bracket. A first gusset 74 is welded between the top of the tube 66 and the side of the short tube 70 and a second gusset 76 is welded between the bottom of the plate extension 64 and the short tube 70 for reinforcement. The welded assembly including elements 60–76 comprise the main bracket 80.

An adjustable bracket 82, separately shown in FIG. 14 is a U-shaped part having a bottom portion 84 containing a slot 86 for the attachment of the applicator 16 and for minor adjustment to maintain optimal delivery of the lubricant. The bracket 82 has sides 88 containing mounting holes 90. The top edge of the bracket 82 and the holes 90 are angled to position the bottom portion 84 at the correct angle to align the applicator to the wheel flange.

As shown in FIG. 15, the detachable version of the mounting bracket 80' is similar to the fixed version, but differs in the attachment of the short tube and uses a structural angle 92 instead of the tube 66 for stiffening the plate 60'. A pad 94 is welded to the extension 64' at the end of the angle 92 and contains threaded bores for bolts 95. A plate 96 with bolt holes is removably attached by bolts 95 to the pad 94. A short rectangular tube 70' is welded to the end of the plate 96 and is reinforced by gussets 100. The tube 70' is arranged like tube 70 described above and has slots 72' for mounting the adjustable bracket 82.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. In a locomotive having axle mounted wheels supporting a truck wherein the truck has an axle associated unsprung portion and each wheel includes a flange and is rotatable on an axis, a rail lubrication system comprising:

a tubular applicator having an outlet for dispensing lubricant;

solid lubricant held within the applicator for application to a locomotive wheel flange;

means for holding the applicator adjacent a wheel flange for lubricant application to the flange, said holding means including a first bracket secured to the axle associated unsprung portion of the truck near a wheel and extending toward the wheel periphery and a second bracket adjustably secured to the first bracket and attached to the tubular applicator to adjustably position said outlet of the applicator adjacent the flange;

wherein the holding means support the applicator at a substantial angle from the top of the wheel but not more than about 45° around the wheel axis.

2. The invention as defined in claim 1 including adjustment means for adjusting the second bracket on the first bracket comprising slots in one of the brackets parallel to the wheel radius for adjustment parallel to the radius.

3. The invention as defined in claim 1 wherein the second bracket extends beyond the wheel periphery and the tubular applicator is mounted on the second bracket at an angle so that said applicator outlet is adjacent the flange.

4. The invention as defined in claim 1 wherein the first and second brackets hold the applicator at a position on the wheel on the order of 45° from the vertical plane of the wheel axis.

5. The invention as defined in claim 1 wherein the applicator comprises a rectangular tubular body for containing the solid lubricant and a spring assembly within the tubular body for pushing the lubricant from the applicator;

the spring assembly comprising a sleeve, a pair of coiled flat springs each having one end fastened at said outlet of the applicator and the other end coiled around the sleeve, and plastic end plugs press fit into the sleeve ends for retaining the springs on the sleeve and for sliding engagement with the tubular body.

6. The invention as defined in claim 1 wherein the applicator comprises a rectangular tubular body having an open end comprising the outlet for dispensing the solid lubricant; and a nozzle loosely slidable on the body and surrounding the outlet, the nozzle including inwardly projecting fingers for lightly engaging the solid lubricant so that as the lubricant advances toward the wheel the nozzle is moved against the wheel.

7. The invention as defined in claim 1 wherein the lubricant is in the form of a solid block;

the applicator comprises a rectangular tubular body having an open end comprising the outlet for dispensing the solid lubricant and wherein the body is spaced from the wheel by a gap;

spring means in the body for pushing the lubricant block against the wheel; and means for bridging the gap between the body and the wheel comprising a nozzle loosely slidable on the body and surrounding the outlet and frictionally engaging the lubricant block, whereby the nozzle is biased against the wheel by the movement of the lubricant block.

8. In a locomotive truck with journal boxes closely adjacent associated wheels having peripheral flanges, a rail lubricant application apparatus comprising:

a lubricant applicator for dispensing lubricant onto a wheel flange;

a first bracket having a lower end bolted to the journal box between the wheel and the journal box and an upper end extending toward the wheel periphery; and a second bracket adjustably supported on the upper end of the first bracket and having a mounting surface attached to the applicator adjacent the flange;

wherein the upper end of the first bracket has slots extending parallel to a wheel radius for adjustably connecting the brackets.

9. In a locomotive truck with journal boxes closely adjacent associated wheels having peripheral flanges, a rail lubricant application apparatus comprising:

a lubricant applicator for dispensing lubricant onto a wheel flange;

a first bracket having a lower end bolted to the journal box between the wheel and the journal box and an upper end extending toward the wheel periphery; and a second bracket adjustably supported on the upper end of the first bracket and having a mounting surface attached to the applicator adjacent the flange;

wherein the first bracket comprises a plate including the lower end and the upper end of the first bracket and channel means welded to the plate intermediate the lower and upper ends to form reinforcing box means.

10. The invention as defined in claim 9, said channel means comprising a first channel extending from adjacent the lower end and attached to one side of the plate and a second channel extending from adjacent the upper end and attached to the other side of the plate, the channels being partially overlapped and forming with the plate reinforcing box sections.

11. The invention as defined in claim 9 wherein the channel means comprises at least one channel having a pair of spaced flanges connected by a web and wherein the web is spaced from the plate and the flanges are welded to the plate.

12. The invention as defined in claim 10 wherein the first channel is located on the side of the plate toward the wheel and extends toward a recess thereof and the second channel is located on the side of the plate away from the wheel and radially opposite the wheel rim.

13. In a locomotive truck with wheels having peripheral flanges and axle supported traction motor means between the wheels, a rail lubricant application apparatus comprising;

a first bracket supported on the motor means near a wheel, the first bracket including a mount having at least one mounting slot generally aligned with the wheel radius;

a second bracket adjustably mounted on the slotted mount of the first bracket for movement relative to the wheel along the wheel radius; and a lubricant applicator secured to the second bracket and positioned at the wheel periphery to dispense lubricant to the wheel flange.

14. The invention as defined in claim 13 wherein the first bracket comprises a plate secured to the motor means, elongated reinforcing means on the plate and extending toward the wheel, and the reinforcing means carrying the mount.

15. The invention as defined in claim 14 wherein the reinforcing means is a rectangular stiffening tube extending beyond the plate and having an end fixed to the mount.

16. The invention as defined in claim 14 wherein the reinforcing means includes a pad having threaded bores, and the mount is removably attached to the reinforcing means by bolts coupled to the threaded bores.

17. The invention as defined in claim 14 wherein the mount comprises a rectangular mounting tube aligned with the wheel radius and having mounting slots in two opposite sides of the tube.

18. The invention as defined in claim 13 wherein the second bracket comprises a generally U-shaped channel with sides and a connecting web, the web being disposed at an angle to the wheel radius and serving as a mounting surface for the lubricant applicator to hold the applicator at such an angle.

19. The invention as defined in claim 13 wherein the second bracket comprises a generally U-shaped channel with sides and a connecting web, the sides being adjustably secured to the mounting slots, and the web being disposed at an angle to the wheel radius and serving as a mounting surface for the lubricant applicator.

* * * * *